US005548948A

United States Patent [19]

Smith et al.

[11] Patent Number: 5,548,948

[45] Date of Patent: Aug. 27, 1996

[54] INFLATABLE SADDLE SUPPORT APPARATUS

[76] Inventors: Scott C. Smith; Julie T. Smith; Holly A. Foster, all of Rte. 2 Box 370A, Marshall, Tex. 75670

[21] Appl. No.: 283,205

[22] Filed: Jul. 28, 1994

[51] Int. Cl.[6] ..... B68C 1/12

[52] U.S. Cl. ..... 54/66; 54/44.6; 297/DIG. 3

[58] Field of Search ..... 54/44.6, 65, 66; 297/119, DIG. 3

[56] References Cited

U.S. PATENT DOCUMENTS

| | | | |
|---|---|---|---|
| 1,795,304 | 3/1931 | Howard | 297/DIG. 3 X |
| 4,708,393 | 11/1987 | Fallis et al. | 297/DIG. 3 X |

FOREIGN PATENT DOCUMENTS

| | | | |
|---|---|---|---|
| 2667584 | 4/1992 | France | 54/65 |
| 569663 | 2/1933 | Germany | 54/44.6 |
| 584194 | 9/1933 | Germany | 54/44.6 |

*Primary Examiner*—Robert P. Swiatek
*Attorney, Agent, or Firm*—John M. Harrison

[57] ABSTRACT

An inflatable saddle support apparatus which is characterized in a first preferred embodiment by an inflatable saddle bladder that fits beneath a saddle and serves to equalize the pressure applied by the saddle and rider to a horse. In a most preferred embodiment of the invention the saddle bladder is shaped to effectively fill the voids between the saddle and the horse and is attached to a felt pad by a seam or by means of loop-pile fasteners. A segment of a conventional saddle blanket is first placed on the horse and receives the saddle bladder, with the felt pad positioned on top of the saddle bladder. The saddle blanket is then folded over the felt pad to receive a saddle. The saddle bladder may be inflated without dismounting by squeezing an inflation bulb which communicates with the inflation chamber of the saddle bladder to provide a selected degree of pressure equalization between the saddle and the horse.

15 Claims, 1 Drawing Sheet

FIG. 1
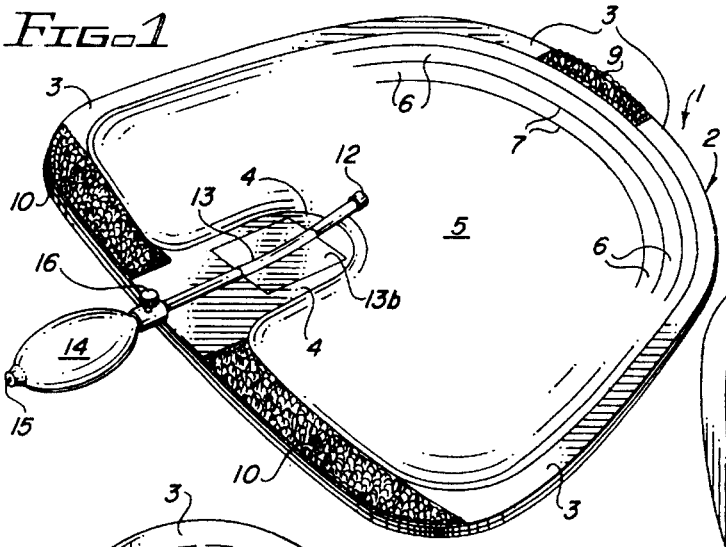
FIG. 3
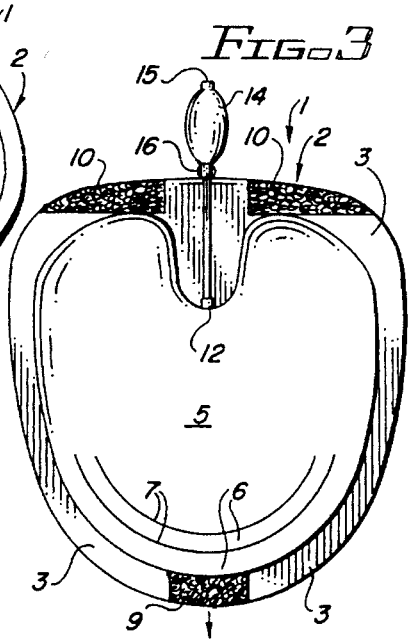
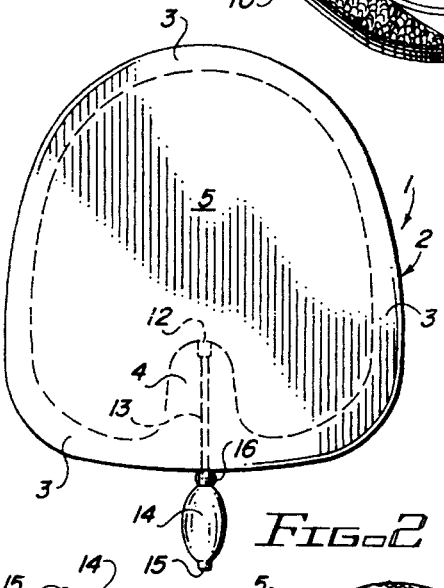
FIG. 2
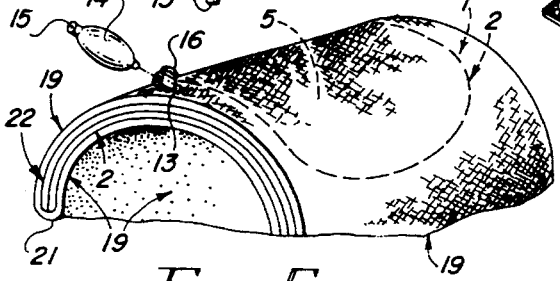
FIG. 5
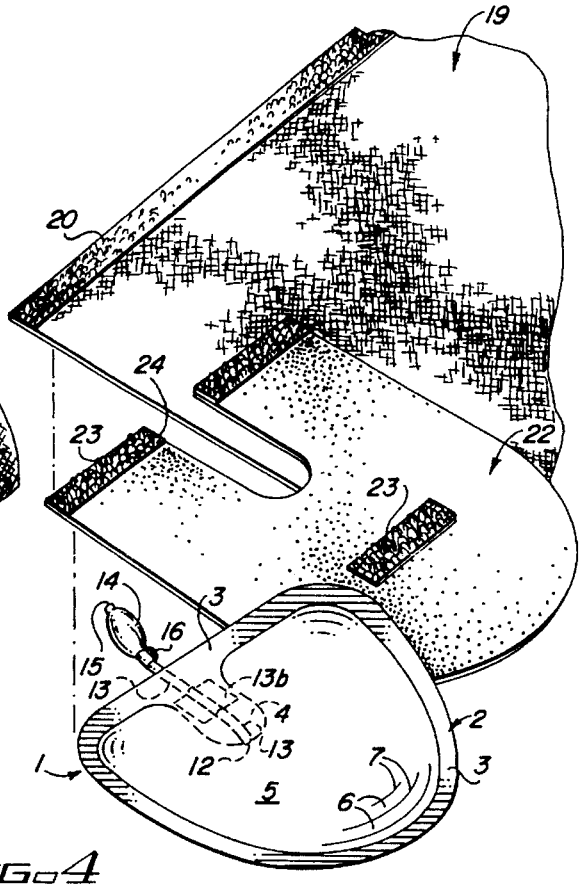
FIG. 4

INFLATABLE SADDLE SUPPORT APPARATUS

BACKGROUND OF THE INVENTION

1. Field of the Invention

This invention relates to saddle pads for horses and more particularly, to an inflatable support apparatus which fits between the saddle and a horse to effectively fill the "hollow spots" gaps, or voids between the saddle and horse and efficiently disperse and distribute the weight of the rider and the saddle throughout the bearing surface of the saddle. The inflatable saddle support apparatus is characterized in a first preferred embodiment by a selectively inflatable, sealed saddle bladder which may be positioned between the horse and saddle. In a most preferred embodiment of the invention the saddle bladder is more particularly located between a saddle blanket position on the horse and a felt pad, which saddle blanket is then folded over the felt pad and receives the saddle. The saddle bladder can be inflated by the rider without the necessity of dismounting, by pressurizing an inflation bulb communicating with the primary inflation chamber of the sealed saddle bladder, to effect the desired degree of pressure equalization between the saddle and the horse.

2. Description of the Prior Art

The fitting of a saddle to a horse has, at best, been an indefinite and unexact practice over a long period of time. Since various types of saddles are manufactured with multiple types and shapes of supporting saddle trees and padding and since horses are of varying size and shape, the saddles many times fit very poorly on the animals. The degree of fit can be determined by sweat marks which show superficial areas of improper fit, but these sweat marks do not reveal the amount of pressure applied by the saddle tree, saddle and rider to the horse. An early attempt to rectify this problem included the use of blankets which were used to protect the sheepskin or leather lining on the underside of the saddle. The effort was designed to at least partially fill in the inverted "V" characterized by the saddle tree, wherein the widest part of the saddle tree rests on the horse. Downwardly-extending sides of the saddle tree become the weight-bearing surfaces of the tree, while the narrower top keeps pressure from the sensitive withers and spinal area of the horse.

Problems with saddle fit may originate from several sources: first of all, the saddle tree itself and the quality of the saddle tree construction are primary factors. A poorly constructed saddle tree is usually found in very low-line saddles and very seldom adequately fits any horse's body. Furthermore, a saddle can be damaged and the tree even broken, for example, in western saddles or shifted stuffing can be the problem in English saddles. If the saddle fits and is relative comfortable on the horse, then the next consideration is the amount and type of padding which may be used to increase the comfort of the horse during riding. Various types and shapes of pads have been developed over the years for this purpose. An "ULTRASOFT" (trademark) gel saddle pad is advertised in the June 1994 issue of "Western Horseman" and includes a saddle pad which is filled with a gel material and is said to be covered by U.S. Pat. Nos. 5,252,373. 226,239, dated Apr. 6, 1880, to H. C. Marsh, details an "Air-Pad For Harness" which includes a generally rectangularly-shaped, inflatable pad that fits beneath the saddle tree of a saddle for padding the saddle against the horse. U.S. Pat. No. 532,419, dated Jan. 8, 1895, to J. B. Haines, Jr., details a "Riding Saddle" which is pneumatically inflated to pad the horse. A "Harness Pad" is detailed in U.S. Pat. No. 539,709, dated May 21, 1895, to J. T. Short. The harness pad is provided with an inflatable bladder and a valve for inflation purposes, to pad the horse while pulling loads. U.S. Pat. No. 550,380, dated Nov. 26, 1895, to E. Plumhoff, details a "Pneumatic Gig Pad". The gig pad is provided with inflatable bladders for inflation to a specified pressure to pad the horse. A "Saddle Pad For Harness" is detailed in U.S. Pat. No. 578,575, dated Mar. 9, 1897, to W. Mathis. The saddle pad is fitted with multiple inflatable tubes for padding the horse while pulling loads. U.S. Pat. No. 709,930, dated Sep. 30, 1902, to H. R. Rensman, details a "Pneumatic Saddle Pad" which fits between the saddle and the horse and includes an inflatable, tube-like member for cushioning the saddle against the horse. U.S. Pat. No. 852,593, dated May 7, 1907, to R. J. Benbo, details a saddle cushion fitted with multiple, concentric, inflatable tubes for cushioning the saddle against the horse. U.S. Pat. No. 910,689, dated Jan. 26, 1909, to J. M. Kelly, et al, details a "Pneumatic Pad for Harness", which includes an S-shaped, inflatable bladder for fitting beneath the saddle and padding the saddle against the horse. A "Saddle-Cushion Assembly" is detailed in U.S. Pat. No. 3,343,338, dated Sep. 26, 1967, to W. J. K. Stubben. The cushion includes a pair of inflatable bladders fitted over the withers of a horse beneath the saddle, to pad the saddle against the horse. A "Riding Saddle" is detailed in U.S. Pat. No. 4,033,097, dated Jul. 5, 1977, to Michael Petit. The saddle has a seat formed by two inflatable cushions disposed on each side of the medium plane of the saddle. A pommel constituted by an upwardly-projecting, inflatable, curved element is assembled with the front edge of the cushions. An inflatable cantle is also assembled with the rear edge of the seat. U.K. Patent No. 2,090,512, dated Jul. 14, 1982, to H. C. Schaupp, details "Saddle Numnahs" for placing on a horse's back beneath the saddle. The devices include an air cushion inserted in a pocket in a main body portion of each numnah. The air cushion has a mouth-inflatable valve and is bonded around its edge and along bond lines which divided into multiple air compartments intercommunicating by means of gaps in the bond lines. German Patent No. 2428852 details a device designed to protect a horse from injury and includes a pneumatic tube fitted with valves in the form of a cushion which, when inflated, is arch-shaped to fit over the back of the horse under the saddle to pad the saddle against the horse. These devices have a common goal of padding the saddle, with no particular regard or concern for filling the voids or gaps between the horse and the saddle.

It is an object of this invention to provide a new and improved inflatable saddle support apparatus which is designed to fill the voids existing between the saddle tree or padding of a saddle and a horse and more evenly distribute the pressure of the saddle against the horse.

Another object of this invention is to provide an inflatable saddle support apparatus which is characterized by a shaped saddle bladder which is inflatable by means of a connecting inflation bulb and is designed to fill the voids between the saddle and a horse, to distribute the pressure of a rider and saddle on a horse in a more optimum manner.

Still another object of this invention is to provide an inflatable saddle support apparatus which compensates for the difference in size and shape of a horse and is characterized by a sealed saddle bladder fitted with at least one shaped inflation chamber that is inflatable by means of a connecting inflation bulb and is designed to fill the gap or voids between the saddle tree or pad and the horse, to better distribute the weight of the rider and saddle on the horse.

A still further object of this invention to provide an inflatable saddle support apparatus which includes a saddle bladder having a primary inflation chamber and multiple rear inflation chambers, with a flat, non-inflatable area at the front of the saddle. Further included is a valve stem inflation tube and inflation bulb for inflating the primary inflation chamber and forward inflation chambers, to fill the gaps or voids between the saddle tree or padding and the horse and distribute the pressure of a rider and saddle on the horse in an optimum manner. The saddle bladder may be sewn or removably connected to a felt pad and sandwiched between the folds of a saddle blanket to support a saddle.

SUMMARY OF THE INVENTION

These and other objects of the invention are provided in an inflatable saddle support apparatus which is characterized by an inflatable saddle bladder sewn or removably attached by means of loop-pile fasteners to a felt pad, which pad is, in turn, attached by means of a loop-pile fastener to a saddle blanket. The saddle bladder is characterized by a primary inflation chamber and, in a preferred embodiment, multiple rear inflation chambers, coupled with a flat non-inflatable area or bladder seal at the front of the saddle and further includes a valve stem communicating with the inflation chambers, an inflation tube attached to the valve stem and an inflation bulb attached to the inflation tube. These elements facilitate inflating the primary inflation chamber and rear inflation chambers to a desired extent by a rider without dismounting, and filling the voids and gaps between the saddle tree or saddle padding and the horse, to more evenly distribute the pressure of a rider and saddle on the animal.

The invention will be better understood by reference to the accompanying drawing, wherein:

FIG. 1 is a perspective view of a preferred embodiment of the inflatable saddle support apparatus of this invention in partially inflated configuration, with the top of the inflatable saddle bladder facing upwardly;

FIG. 2 is a bottom view of the inflatable saddle support apparatus illustrated in FIG. 1;

FIG. 3 is a top view of the inflatable saddle support apparatus illustrated in FIGS. 1 and 2;

FIG. 4 is an exploded view, more particularly illustrating positioning of the saddle bladder of the inflatable saddle support apparatus illustrated in FIGS. 1–3, beneath a felt pad and a saddle blanket; and FIG. 5 is a composite view of the inflatable saddle bladder, the felt pad and the folded saddle blanket in functional configuration as mounted on a horse and ready to receive a saddle.

DESCRIPTION OF THE PREFERRED EMBODIMENTS

Referring initially to FIGS. 1–3 of the drawing, in a preferred embodiment, the inflatable saddle support apparatus of this invention is generally illustrated by reference numeral 1. The inflatable saddle support apparatus 1 is characterized by a rounded, inflatable saddle bladder 2, which is glued or otherwise sealed at a sealed bladder edge 3 and a bladder seal 4 at the front thereof, to define a primary inflation chamber 5. Optional but preferred rear inflation chambers 6, defined by spaced, curved rear inflation chamber seals 7 are also provided in the rear of the saddle bladder 2 for purposes which will be hereinafter further described. A valve stem 12 is sealed in the top of the saddle bladder 2 at the upper end of the bladder seal 4 and one end of an inflation tube 13 is attached to the valve stem 12, while the other end of the inflation tube 13 receives an air inlet valve 16 and an inflation bulb 14, as illustrated. A tube retainer patch 13b is placed over the inflation tube 13 and adheres to the bladder seal 4, in order to position the inflation tube 13 to removably receive the inflation bulb 14. A check valve 15 is also provided in the inflation bulb 14, along with the air inlet valve 16, to facilitate selectively inflating and deflating the primary inflation chamber 5 and optional rear inflation chambers 6, as desired.

As further illustrated in FIGS. 1 and 3, in a most preferred embodiment of the invention the rear inflation chambers are partially sealed with respect to each other along the rear chamber seals 7, but are not sealed with respect to the primary inflation chamber 5, such that inflation of the primary inflation chamber 5 also inflates the rear inflation chambers 6. This expedient facilitates inflation of the primary inflation chamber as well as the rear end of the saddle bladder 2 beneath the cantle (not illustrated) of a saddle (not illustrated), in order to be sure that the voids beneath the saddle tree (not illustrated) are fully filled and no part of the saddle tree or saddle padding touches the horse's body. The flat bladder seal 4 insures that no pressure is applied to the withers of the horse.

Referring now to FIGS. 1, 4 and 5 of the drawings, in another preferred embodiment of the invention, the inflatable saddle support apparatus 1 includes a saddle bladder 2 fitted with a rear loop element 9 and forward loop elements 10, which match the corresponding felt pad pile elements 23 of a felt pad 22, having a felt pad slot 24, as illustrated in FIG. 4. Furthermore, the pile element 20 sewn along one edge of a saddle blanket 19, is secured to additional loop elements (not illustrated) provided on the felt pad 22, in order to sandwich the felt pad 22 between one fold or panel of the saddle blanket 19 and the saddle bladder 2 and seat the saddle bladder 2 on a second fold or panel of the saddle blanket 19, as further illustrated in FIGS. 4 and 5. Alternatively, and in a most preferred embodiment of the invention, the felt pad 22 is sewn to the sealed bladder edge 3, such that the saddle bladder 3 and felt pad 22 are a composite. This composite fits between the folds or panels of the saddle blanket 19 to receive a saddle, as described above. When the inflatable saddle bladder 2 and the felt pad 22 are sandwiched between the folded panels of the saddle blanket 19 as illustrated in FIG. 5, the inflation bulb 14 is removed from the extending end of the inflation tube 13 and the inflation tube 13 is projected through the felt pad slot 24 and an opening in the saddle blanket 19, to position the inflation bulb 14 beneath the pommel of a saddle (not illustrated) and facilitate inflation or deflation of the saddle bladder 2, as desired, in order to compensate for the weight of the rider and the saddle on the horse. The bladder seal 4 prevents inflation of the centermost front portion of the saddle bladder 2 on the withers area of the horse's back where no inflation is necessary. The inflation of the primary inflation chamber 5 and optionally, the rear inflation chambers 6, thus scales the inflation from a no inflation condition at the sealed bladder loop 4, rearwardly throughout the primary inflation chamber 5 to the rear inflation chambers 6, which lie beneath the cantle portion of the saddle. Adjustment of the volume of air in the primary inflation chamber 5 and rear inflation chambers 6 is effected by manipulation of the air inlet valve 16 on the inflation bulb 14 to maintain a comfortable and optimum distribution of pressure on the horse's back.

In use, and referring again to FIGS. 4 and 5 of the drawing, the saddle bladder 2 of the inflatable saddle support apparatus 1 is initially placed directly on a horse's back above the withers and over shoulder blades, extending rearwardly toward the flank area. A saddle may then be placed directly over the saddle bladder 2, with the front edge of the saddle resting several inches behind the front edge of the saddle bladder 2. The primary inflation chamber 5 of the saddle bladder 2 should be fully or partially deflated when saddling. The saddle is then secured in the normal manner for proper and safe use. After the saddle is secured on the horse, air is introduced into the primary inflation chamber 5 and the rear inflation chambers 6 by opening the air inlet valve 16 on the inflation bulb 14 and pumping the inflation bulb 14. Sufficient air should be added to the primary inflation chamber 5 and rear inflation chambers 6 to facilitate expansion of the primary inflation chamber 5 and rear inflation chambers 6 into the areas of least resistance or the so-called "hollow spots", gaps or voids between the saddle and the saddle bladder 2. This facilitates optimum distribution of pressure between the saddle and the horse.

In another preferred embodiment of the invention, under circumstances where the inflatable saddle support apparatus 1 is characterized by the saddle bladder 2, the felt pad 22 and the saddle blanket 19, one panel or fold of the saddle blanket 19 is placed on the horse and the saddle bladder 2 is then positioned on the saddle blanket 19. A shaped felt pad 22 is then positioned over the saddle bladder 2, with the felt pad pile elements 23 engaging the corresponding rear loop element 9 and front loop elements 10, respectively, on the saddle bladder 2. The saddle blanket 19 is then folded at a blanket fold 21, illustrated in FIG. 5, over the felt pad 22, with the saddle blanket pile element 20 engaging the corresponding felt pad loop element (not illustrated) on the felt pad 22, as illustrated in FIGS. 4 and 5. Alternatively, as described above, the saddle bladder 12 can be sewn to the felt pad 22 along the sealed bladder edge 3 and the saddle bladder 12-felt pad 22 composite sandwiched between the folds or panels of the saddle blanket 19. It is expedient to attach the three elements of the inflatable saddle support apparatus 1, to serve as cushioning to the horse and to facilitate less movement of the saddle bladder 2 of the inflatable saddle support apparatus 1 with respect to the horse during riding. The air inlet valve 16 is then opened and the inflation bulb 14 pumped to provide sufficient pressure in the primary inflation chamber 5 and rear inflation chambers 6 of the saddle bladder 2 to facilitate resting of the saddle on the horse's back as it was designed, thus forming a uniform and optimum support area for weight distribution, regardless of the size and shape of the horse. Accordingly, the inflatable saddle support apparatus 1 serves to correct saddle imperfections, bridge gaps and promote pressure distribution where the saddle tree or saddle pad is not meeting the horse's back and thus, helps disperse areas of excessive pressure, while not elevating the saddle tree from areas of the horse's back which are normally contacted.

It will be understood that the saddle bladder 2 can be used as described above with either the felt pad 22 or the saddle blanket 19, as desired.

It will be appreciated by those skilled in the art that the saddle bladder element of the inflatable saddle support apparatus of this invention, in both of the embodiments described above, may be constructed of various rubber compositions or vinyl plastic and sealed by glue, sonic welds or the like, according to the knowledge of those skilled in the art. Furthermore, the felt pad 22 can be shaped from a conventional felt pad, with the felt pad slot 24 configured to match the bladder seal 4 in the saddle bladder 2. In like manner, the saddle blanket 19 is conventional and must be sufficiently large to facilitate folding to receive the saddle bladder 2 on one panel and cover the felt pad 22 with the other panel as the saddle blanket 19 is folded at the blanket fold 21.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An inflatable saddle support apparatus for evenly distributing the pressure of a saddle on a horse, comprising a saddle bladder positionable between the saddle and the horse and having sealed edges, a forward portion and a rear portion; a non-inflatable bladder seal provided in said forward portion of said saddle bladder; a primary inflation chamber extending from said bladder seal and said forward portion of said saddle bladder toward said rear portion and at least one rear inflation chamber defined in said rear portion of said saddle bladder, said at least one rear inflation chamber communicating with said primary inflation chamber; and pump means communicating with said primary inflation chamber for selectively inflating and deflating said saddle bladder.

2. The inflatable saddle support apparatus of claim 1 wherein said pump means comprises a valve stem mounted on said saddle bladder at said bladder seal and communicating with said primary inflation chamber; an inflation tube having one end connected to said valve stem; and an air inlet valve and a bulb connected to the opposite end of said inflation tube, for selectively pumping air into said primary inflation chamber responsive to pressure applied to said bulb in releasing air from said primary inflation chamber responsive to opening of said air inlet valve.

3. The inflatable saddle support apparatus of claim 1 wherein said at least one rear inflation chamber comprises a pair of rear inflation chambers in said rear portion of said saddle bladder.

4. The inflatable saddle support apparatus of claim 1 comprising bladder attachment means provided on said saddle bladder, a felt pad covering said saddle bladder and first and second pad attachment means provided on said felt pad, said first pad attachment means engaging said bladder attachment means and securing said saddle bladder and said felt pad in a desired position on the horse.

5. The inflatable saddle support of claim 4 wherein said pump means comprises a valve stem mounted on said saddle bladder at said bladder seal and communicating with said primary inflation chamber; an inflation tube having one end connected to said valve stem; and an air inlet valve and a bulb connected to the opposite end of said inflation tube, for selectively pumping air into said primary inflation chamber responsive to pressure applied to said bulb in releasing air from said primary inflation chamber responsive to opening of said inlet valve.

6. The inflatable saddle support of claim 5 wherein said at least one rear inflation chamber comprises a pair of rear inflation chambers in said rear portion of said saddle bladder.

7. The inflatable saddle support apparatus of claim 4 comprising a saddle blanket folded under said saddle bladder against the horse and over said felt pad and saddle blanket attachment means provided on said saddle blanket for engaging said second pad attachment means on said felt pad and securing said saddle blanket to said felt pad.

8. The inflatable saddle support apparatus of claim 7 wherein said pump means comprises a valve stem mounted on said saddle bladder at said bladder seal and communicating with said primary inflation chamber; at least one inflation tube having one end connected to said valve stem; and an air inlet valve and a bulb connected to the opposite end of said at least one inflation tube, for selectively pumping air into said primary inflation chamber responsive to pressure applied to said bulb and releasing air from said primary inflation chamber responsive to opening of said air inlet valve.

9. The inflatable saddle support apparatus of claim 7 wherein:

(a) said pump means comprises a valve stem mounted on said saddle bladder at said bladder seal and communicating with said primary inflation chamber; at least one inflation tube having one end connected to said valve stem; an air inlet valve and a bulb connected to the opposite end of said at least one inflation tube, for selectively pumping air into said primary inflation chamber responsive to pressure applied to said bulb and releasing air from said primary inflation chamber responsive to opening of said air inlet valve.

10. The inflatable saddle support apparatus of claim 9 wherein said at least one rear inflation chamber comprises a pair of curved rear inflation chambers in said rear portion of said saddle bladder.

11. An inflatable saddle support apparatus for positioning between a saddle and a horse and when inflated, filling the voids between the saddle and the horse, said inflatable saddle support apparatus comprising an inflatable saddle bladder having sealed edges, a forward portion and a rear portion; a primary inflation chamber provided in said saddle bladder extending from said forward portion toward said rear portion; at least one rear inflation chamber provided on said rear portion of said saddle bladder and communicating with said primary inflation chamber; a flat, non-inflatable bladder seal provided in said forward portion of said saddle bladder; a valve stem provided in said saddle bladder at one end of said bladder seal, said valve stem communicating with said primary inflation chamber; an inflation tube having one end attached to said valve stem and the opposite end of said inflation tube terminating at the opposite end of said bladder seal; an air inlet valve and a bulb provided on said opposite end of said inflation tube, whereby air is selectively pumped into and released from said primary inflation chamber and said at least one rear inflation chamber responsive to manipulation of said bulb and said air inlet valve, respectively.

12. The inflatable saddle support apparatus of claim 11 wherein said at least one rear inflation chamber comprises a pair of curved rear inflation chambers in said rear portion of said saddle bladder.

13. The inflatable saddle support apparatus of claim 12 comprising bladder attachment means provided on said saddle bladder, a felt pad covering said saddle bladder and first and second pad attachment means provided on said felt pad, said first pad attachment means engaging said bladder attachment means and securing said inflatable bladder and said felt pad in a desired position on the horse.

14. The inflatable saddle support apparatus of claim 13 comprising a saddle blanket folded under said saddle bladder against the horse and over said felt pad and saddle blanket attachment means provided on said saddle blanket for engaging said second pad attachment means on said felt pad and securing said saddle blanket to said felt pad.

15. An inflatable support apparatus for positioning between a saddle and a horse and when inflated, filling the voids between the saddle and the horse, said inflatable saddle support apparatus comprising an inflatable saddle bladder having sealed edges, a forward portion and a rear portion; a primary inflation chamber provided in said saddle bladder extending from said forward portion toward said rear portion; at least two curved rear inflation chambers provided on said rear portion of said saddle bladder and communicating with said primary inflation chamber; a flat, non-inflatable bladder seal provided in said forward portion of said saddle bladder; a felt pad attached to said saddle bladder; a saddle blanket folded under said saddle bladder between said saddle bladder and the horse and over said felt pad for receiving the saddle; a valve stem provided in said saddle bladder at one end of said bladder seal, said valve stem communicating with said primary inflation chamber; an inflation tube having one end attached to said valve stem and the opposite end of said inflation tube terminating at the opposite end of said bladder seal; an air inlet valve and a bulb provided on said opposite end of said inflation tube, whereby air is selectively pumped into and released from said primary inflation chamber and said rear inflation chambers, responsive to manipulation of said bulb and said air inlet valve, respectively.

* * * * *